US007870910B2

(12) United States Patent
Heichel et al.

(10) Patent No.: US 7,870,910 B2
(45) **Date of Patent: *Jan. 18, 2011**

(54) VIBRATION GENERATOR FOR A VIBRATION PILE DRIVER

(75) Inventors: Christian Heichel, Niedernberg (DE); Albrecht Kleibl, Grosshennersdorf (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 152 days.

This patent is subject to a terminal disclaimer.

(21) Appl. No.: 12/317,118

(22) Filed: Dec. 19, 2008

(65) Prior Publication Data

US 2009/0188687 A1 Jul. 30, 2009

(30) Foreign Application Priority Data

Jan. 29, 2008 (EP) ..... 08001600

(51) Int. Cl.
*E02D 7/18* (2006.01)

(52) U.S. Cl. ..... 173/49; 173/90; 173/142; 173/164

(58) Field of Classification Search ..... 173/49, 173/90, 142, 164
See application file for complete search history.

(56) References Cited

U.S. PATENT DOCUMENTS 3,783,954 A * 1/1974 Bodine ..... 173/49
4,143,719 A * 3/1979 Furukawa et al. ..... 173/1
5,168,938 A * 12/1992 Sano et al. ..... 173/11
5,410,879 A 5/1995 Houze
5,540,295 A * 7/1996 Serrette ..... 175/56
5,725,329 A 3/1998 Chelminski
5,988,297 A * 11/1999 Zimmerman et al. ..... 173/49
2008/0218013 A1 9/2008 Heichel et al.
2009/0189467 A1 * 7/2009 Heichel et al. ..... 310/81

FOREIGN PATENT DOCUMENTS

| | | |
|---|---|---|
| DE | 20 2007 005 283 | 8/2007 |
| EP | 0 577 444 | 1/1994 |
| EP | 0 936 300 | 8/1999 |
| EP | 0 951 949 | 10/1999 |

* cited by examiner

*Primary Examiner*—Brian D Nash
(74) *Attorney, Agent, or Firm*—Collard & Roe, P.C.

(57) ABSTRACT

A vibration generator for a vibration pile driver has imbalance masses that can rotate and which are disposed on shafts. The rotational position of the imbalance masses can be adjusted relative to one another. A control and regulation circuit is provided which has a memory unit for storing ground composition data sets or task-specific default data sets with defined operational characteristic variables. The unit also has sensors for continuous detection of the defined operational characteristic variables, an evaluation unit for comparing the operational characteristic variables that are determined with the operational characteristic variables of the selected default data set, a regulation device for regulating the vibration generator, and a control device for controlling the adjustment of the rotational position of the imbalance masses relative to one another. The vibration generator is part of a vibration pile driver.

15 Claims, 2 Drawing Sheets

VIBRATION GENERATOR FOR A VIBRATION PILE DRIVER

CROSS REFERENCE TO RELATED APPLICATIONS

Applicants claim priority under 35 U.S.C. §119 of European Application No. 08001600.9 filed Jan. 29, 2008.

BACKGROUND OF THE INVENTION

1. Field of the Invention

The invention relates to a vibration generator for a vibration pile driver and to a vibration pile driver.

2. The Prior Art

In construction, vibration generators are used to introduce objects, such as profiles, into the ground, or to draw them from the ground, or also to compact ground material. The ground is excited by vibration, and thereby achieves a "pseudo-fluid" state. The goods to be driven in can then be pressed into the construction ground by a static top load. The vibration is characterized by a linear movement and is generated by rotating imbalances that run in opposite directions, in pairs, within a vibrator gear mechanism. Vibration generators are characterized by the rotating imbalance and by the maximal speed of rotation.

Vibration generators are vibration exciters having a regular linear effect, whose centrifugal force is generated by rotating imbalances. These vibration exciters move at a changeable speed. The size of the imbalance is also referred to as a "static moment." The progression of the speed of the linear vibration exciter corresponds to a periodically recurring function, for example a sine function, but it can also assume other shapes. The characteristics of the vibration generator can be influenced by way of the static moment, the speed of rotation, and the static top load. These are essential operational characteristic variables for vibration generation. Disadvantageous operational characteristic variables cause a great power loss and a reduction in the efficiency of the vibration generator. In this connection, the amount of the power loss is particularly influenced also by the composition of the penetration medium, i.e. the medium or the ground into which the goods to be driven in are being introduced. In practice, it has been proven to be complicated and problematic to coordinate the operational parameters to the composition of the medium being penetrated.

SUMMARY OF THE INVENTION

It is therefore an object of the invention to provide a vibration generator that allows a reduction in the power losses indicated by disadvantageous operational characteristic variables, and thus allows energy-efficient operation. According to the invention, this task is accomplished by a vibration generator for a vibration pile driver, comprising rotatable imbalance masses disposed on shafts, and means for adjusting the rotational position of the imbalance masses relative to one another. A control and regulation circuit is provided, which has the following components:

a memory unit for storing ground composition data sets or task-specific default data sets with defined operational characteristic variables, from which a required data set can be selected, sensors for continuous detection of the defined operational characteristic variables, an evaluation unit for comparing the operational characteristic variables that are determined with the operational characteristic variables of the selected default data set, a regulation device coupled with the evaluation unit for regulating the vibration generator, and a control device coupled with the regulation device, for controlling the means for adjusting the rotational position of the imbalance masses relative to one another.

With the invention, a vibration exciter is created that allows a reduction in the power losses indicated by disadvantageous operational characteristic variables, and thus allows energy-efficient operation. By providing a memory unit for storing default data sets with defined operational characteristic variables of the vibration generator relating to ground composition or specific tasks, it is possible to provide empirical values acquired in practice, in the manner of an expert system. In this way, simple setting of the vibration generator can take place as a function of the set task, by selecting an operational characteristic variable data set to be selected on the basis of the task, in each instance.

In a further development of the invention, sensors for detecting the frequency, the static top load, and the relative position of the imbalance masses with regard to one another are disposed.

Preferably, the sensors comprise at least one inductive sensor and/or one rotary position transducer. Such sensors have proven to be long-lasting and robust. It is advantageous if a sensor is disposed for detecting the acceleration of the rotating shafts. Supplementally, a sensor can be disposed for detecting the amplitude of the vibrations of the vibration generator.

In a further development of the invention, the sensors are connected with an evaluation unit that compares the measurement values determined by the sensors with stored maximal values. In this way, detection of load peaks is made possible. Preferably, the evaluation unit determines the each static moment that is applied on the basis of the measurement values determined by the sensors.

In an embodiment of the invention, a device for automatic selection of a default data set on the basis of the acceleration values that are determined is provided. In this way, automatic programming can be implemented, by means of which automatic selection of the most efficient default variables takes place as a function of the task-specific operational situation, without any operator intervention being required. Alternatively, a semi-automatic system can also be implemented, in which an operational characteristic variable data set is suggested to the operator, and can be confirmed or changed by the operator.

It is advantageous if the evaluation unit has a memory-programmable control (programmable logic controller PLC). In this way, flexible control of the vibration generator is made possible.

In a further development of the invention, an acoustical and/or optical warning device is provided to send an alarm in case of incorrect input, and is connected with the evaluation unit. In this way, it can be pointed out to the operator that an adjustment and/or change in the current operational characteristic variables is necessary.

In an embodiment of the invention, at least one hydraulic drive having a changeable suction volume is provided. For hydraulic drives, a higher static moment can be achieved, at the same drive power, by a lower speed of rotation, thereby bringing about a greater ground vibration at the same time. In inner city regions, ground vibrations can be reduced by operation at a higher speed of rotation, but in this way, the static moment is reduced at the same time. In the case of hydraulic drives having a constant suction volume, the aforementioned measures prove to be problematic, since the drive power is dependent on the speed of rotation. The power curve can be adapted accordingly when the speed of rotation changes, by changing the suction volume of the hydraulic drive.

Preferably, a regulation mechanism is provided, by way of which the suction volume can be adjusted as a function of the operational pressure or speed of rotation. It is advantageous if an operational pressure limit and/or a speed of rotation limit can be set.

It is another object of the invention to provide a vibration pile driver that allows a reduction in the power losses indicated by disadvantageous operational characteristic variables, and thus allows energy-efficient operation. According to the invention, this task is accomplished by a vibration pile driver, comprising a movable vibration generator as described above, and/or an accommodation for a material to be pile-driven.

With the invention, a vibration pile driver is created, which allows a reduction in the power losses indicated by disadvantageous operational characteristic variables, and thus allows energy-efficient operation.

In an embodiment of the invention, a sensor is disposed for detecting the forces that act on the material to be pile-driven. Characterization of the ground composition is made possible by determining this variable. This characterization can be improved by the preferred placement of at least one sensor for detecting the vibrations of the penetration medium, which can be applied to the penetration medium, which sensor is connected with the evaluation unit. Preferably, a sensor for detecting the penetration speed of the pile-driven material is provided.

In a preferred further development of the invention, a device for automatic selection of a default data set on the basis of the forces that are determined and act on the pile-driven material and/or of the speed and acceleration of the pile-driven material and/or of the detected vibrations of the penetration medium is provided. In this way, automatic programming can be implemented, by means of which automatic selection of the most efficient default variables takes place as a function of the task-specific operational situation, without any operator intervention being required. Alternatively, a semi-automatic system can also be implemented, in which an operational characteristic variable data set is suggested to the operator, and can be confirmed or changed by the operator.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
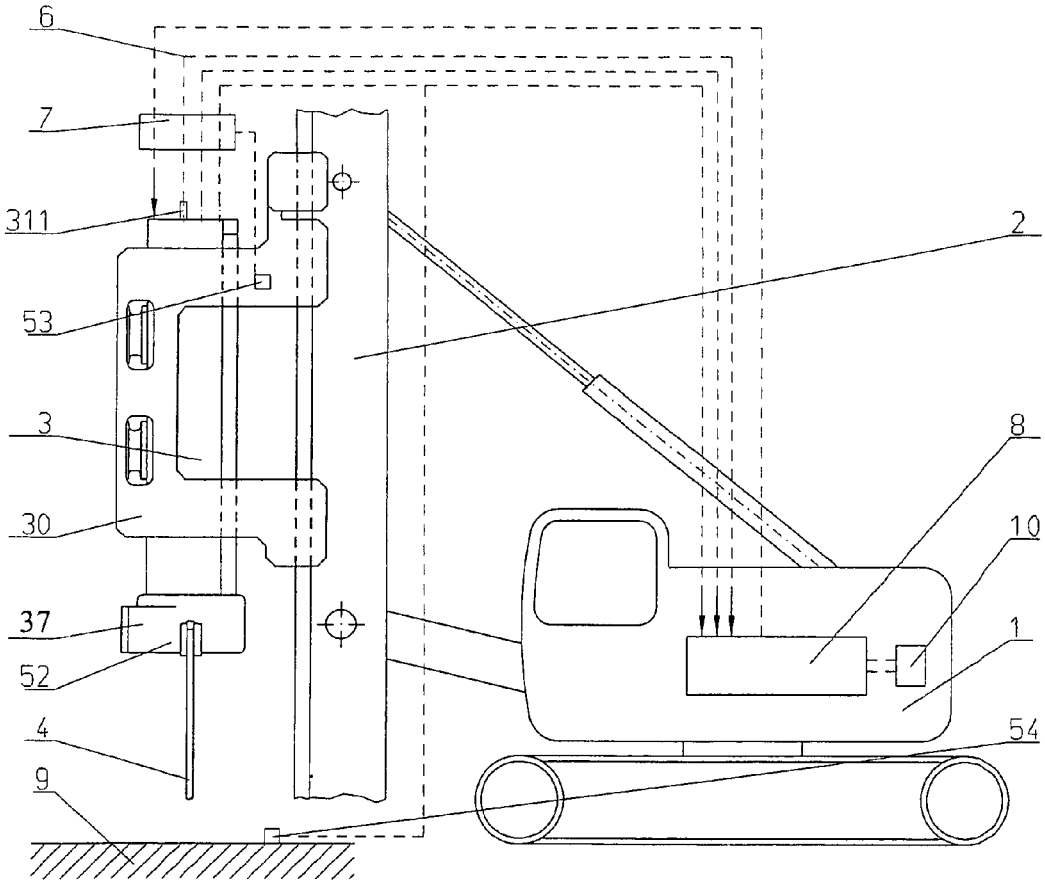
FIG. 1 is a schematic representation of a vibration pile driver with a support device.

The vibration pile driver selected as an exemplary embodiment consists essentially of a support device 1, on which a vibration generator (vibrator) 3 is disposed so that it can be displaced vertically, by way of a mast 2. Vibration generator 3 comprises a housing 31, which is surrounded by a hood 30. Clamping pliers 37 for accommodating pile-driven material 4 are disposed on hood 30. Hood 30 serves to guide vibration generator 3, and transfers the static force of mast 2 to vibration generator 3. Vibration generator 3 generates a vibration, by way of rotating imbalances 3311, 3321, 3331, 3511, 3521, 3531, which vibration is transferred to material 4 to be pile-driven, by way of clamping pliers 37.

Figure 2:
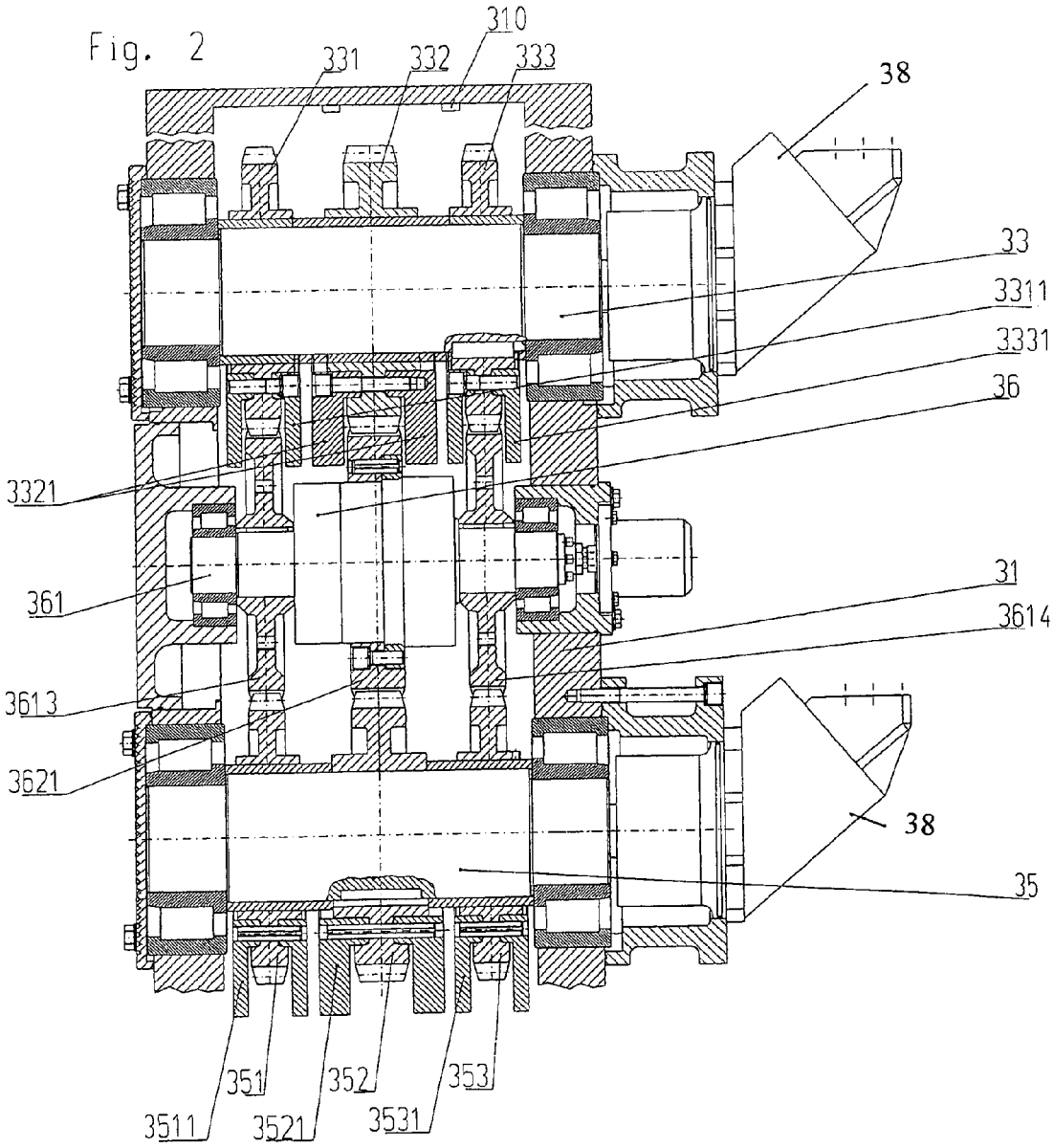
FIG. 2 is a schematic representation of a vibrator gear mechanism in longitudinal section.

Vibration generator 3 is structured as a vibrator gear mechanism (FIG. 2). It consists essentially of a housing 31, in which shafts 33, 35 provided with gear wheels 331, 332, 333, 351, 352, 353 are mounted to rotate. Gear wheels 331, 332, 333, 351, 352, 353 are each provided with imbalance masses 3311, 3321, 3331, 3511, 3521, 3531, whereby the gear wheels of the two shafts 33, 35 are in engagement with one another by way of gear wheels 3613, 3614 of rotor shaft 361 of a pivot motor 36. Gear wheels 331, 332, 333, 351, 352, 353 provided with imbalance masses 3311, 3321, 3331, 3511, 3521, 3531 are adjustable in their rotational position, relative to one another, by way of pivot motor 36, thereby making it possible to adjust the resulting imbalance, i.e. the resulting static moment. Such vibrator gear mechanisms with imbalance masses mounted so as to rotate, which are adjustable in their relative phase position, are known to a person skilled in the art, for example from German Patent No. DE 20 2007 005 283 U1.

Vibration generator 3 is provided with two inductive sensors 310, disposed on the inside of housing 31, parallel to the circumference of the gear wheels, at a distance from one another, lying opposite gear wheels 331, 332, 333, 351, 352, 353, in each instance. Inductive sensors 310 allow detection of the angular acceleration of rotating imbalance masses 3311, 3321, 3331, 3511, 3521, 3531. Furthermore, by way of the time offset of the imbalance masses 3311, 3321, 3331, 3511, 3521, 3531, their position relative to one another can be determined. Furthermore, an acceleration sensor 311 is disposed on housing 31 of vibration generator 3. A memory-programmable control (programmable logic controller PLC) 7 is disposed as an evaluation unit for processing the signals of sensors 310, 311, and determining the aforementioned variables, which control furthermore calculates the static moment that is applied on the basis of the frequency and time offset of the imbalance masses relative to one another. Alternatively, a sensor system having two inductive sensors (in other words one inductive sensor per imbalance cycle) can also be provided, along with an acceleration sensor affixed to the housing of the vibration generator.

Shafts 33, 35 of vibration generator 3 are connected with hydraulic drives 38. In the exemplary embodiment, hydraulic drives 38 have a changeable suction volume.

Switched ahead of PLC 7 is a memory unit 10 that is connected with PLC 7 by way of lines 6. Default data sets specific to the ground composition, with defined operational characteristic variables, are stored in memory unit 10. These default variables are empirically determined variables. In the exemplary embodiment, the PLC 7, together with memory unit 10, forms an automatic programming that selects a corresponding, efficient data set on the basis of the existing ground composition. In the exemplary embodiment, the data sets are coupled with force and acceleration values to be determined, which are passed on to PLC 7 as input variables. In addition, the vibration emission of the surrounding penetration medium is stored in memory as an influence variable.

The determination of the force and acceleration values takes place by way of a force sensor 52 and an acceleration sensor 311. Force sensor 52 is set up in such a manner that it determines the forces that act on the pile-driven material 4, which results from the forces applied by mast 2 and the counter-force generated by the penetration medium, and passes them on to PLC 7 by way of lines 6. Acceleration sensor 311 is set up in such a manner that it determines the penetration speed and acceleration of the pile-driven material 4 into penetration medium 9, and also passes them on to PLC 7 by way of lines 6. Optionally, the penetration speed can be determined with an additional sensor (53), preferably a laser for measuring the distance between vibrator and ground. Alternatively, the determination of the applied force can also take place by way of an acceleration sensor 311 and the dynamic mass.

To determine the vibration emission of ground 9 that surrounds pile-driven material 4, a vibration sensor 54 is affixed to ground 9 at a distance from the penetration location of pile-driven material 4. Vibration sensor 54 determines the vibrations emitted by ground 9 during the pile-driving process, and passes the determined vibration values to PLC 7 by way of a line 6.

On the basis of the force and acceleration values determined in this way, as well as the measured vibration values, the default data set assigned to these values (i.e. to a value range into which the determined values fall) is selected from a memory unit 10; its default values are used for reconciliation with the operational characteristic variables determined by sensors 310, 311. In an alternative embodiment, the selection of a data set by the operator of the vibration pile driver is also possible, by way of a corresponding control panel.

Control 8 is disposed in support device 1, and connected with memory unit 10 and with PLC 7 by way of lines 6. Control 8 is set up in such a manner that it calculates the optimal operational characteristic variables of the vibration generator from the static moment determined by PLC 7 and the acceleration data determined by the sensors 311, against the background of the default characteristic values of the default data set selected from the memory unit 10.

The control 8 is connected with the pivot motor 36 for changing the position of rotation of the imbalance masses relative to one another, which motor is disposed in vibration generator 3. Reconciliation of the actual operational characteristic data detected by sensors 310, 311 with the corresponding default values of the selected default data set takes place by way of control of pivot motor 36. If the permissible acceleration values are exceeded, re-adjustment of the resulting imbalance, i.e. of the resulting static moment, takes place, by way of pivot motor 36, by way of gear wheel 3621.

In addition, the installation of an optical and/or acoustical signal in the operator's cabin of the support device is possible, in order to inform the operator of the fact that permissible acceleration values have been significantly exceeded. In a normal case, this points out that an unsuitable operational characteristic variable set has been selected from the memory unit 10. By activation of the signal, the operator is instructed to review the selection of the default data set and to correct it, if necessary.

Accordingly, while only a few embodiments of the present invention have been shown and described, it is obvious that many changes and modifications may be made thereunto without departing from the spirit and scope of the invention.

What is claimed is:

1. A vibration generator for a vibration pile driver, comprising:

rotatable imbalance masses disposed on shafts;

an adjustment mechanism for adjusting a rotational position of the imbalance masses relative to one another; and a control and regulation circuit comprising;

(a) a memory unit for storing ground composition data sets or task-specific default data sets with defined operational characteristic variables, from which a required data set can be selected;

(b) sensors for continuous detection of the defined operational characteristic variables;

(c) an evaluation unit for comparing the operational characteristic variables that are determined with the operational characteristic variables of a selected default data set;

(d) a regulation device coupled with the evaluation unit, for regulating the vibration generator; and (e) a control device coupled with the regulation device, for controlling the means for adjusting the rotational position of the imbalance masses relative to one another.

2. The vibration generator according to claim 1, wherein the sensors detect frequency and position of the imbalance masses relative to one another.

3. The vibration generator according to claim 1, wherein the sensors comprise inductive sensors or rotary position transducers.

4. The vibration generator according to claim 1, wherein at least one of the sensors detects acceleration of the rotating shafts, said at least one sensor being disposed within the vibration generator.

5. The vibration generator according to claim 1, wherein at least one of the sensors detects acceleration of the vibration generator.

6. The vibration generator according to claim 1, further comprising a device for automatic selection of a default data set on the basis of determined acceleration values.

7. The vibration generator according to claim 1, wherein the evaluation unit determines a static moment that is applied on the basis of measurement values determined by the sensors.

8. The vibration generator according to claim 1, wherein the evaluation unit has a programmable logic controller.

9. The vibration generator according to claim 1, further comprising an acoustic or optical warning device to send an alarm in case of incorrect input, said warning device being connected with the evaluation unit.

10. The vibration generator according to claim 1, further comprising at least one hydraulic drive having a changeable suction volume, said drive being connected to at least one of the shafts for rotating the imbalance masses.

11. A vibration pile driver, comprising a vibration generator according to claim 1, and at least one of a mast on which the vibration generator is movably disposed and an accommodation for a material to be pile-driven.

12. The vibration pile driver according to claim 11, further comprising a sensor for detecting force that acts on the pile-driven material.

13. The vibration pile driver according to claim 11, wherein the vibration pile driver has a mast, and further comprising a sensor for detecting penetration speed of the mast.

14. The vibration pile driver according to claim 11, further comprising at least one external sensor which can be applied to a penetration medium, for detecting vibrations of the penetration medium, said external sensor being connected with the evaluation unit.

15. The vibration pile driver according to claim 11, further comprising a device for automatic selection of a default data set on the basis of force that acts on the pile-driven material, a determined pile-driven material speed or acceleration, or detected vibrations of a penetration medium.

* * * * *